US011498083B2

(12) United States Patent
Kühnert

(10) Patent No.: US 11,498,083 B2
(45) Date of Patent: Nov. 15, 2022

(54) FIXED ANGLE CENTRIFUGE ROTOR WITH STIFFENING RIB

(71) Applicant: Eppendorf AG, Hamburg (DE)

(72) Inventor: Steffen Kühnert, Leipzig (DE)

(73) Assignee: Eppendorf AG, Hamburg (DE)

( * ) Notice: Subject to any disclaimer, the term of this patent is extended or adjusted under 35 U.S.C. 154(b) by 672 days.

(21) Appl. No.: 16/541,538

(22) Filed: Aug. 15, 2019

(65) Prior Publication Data

US 2020/0055060 A1 Feb. 20, 2020

(30) Foreign Application Priority Data

Aug. 16, 2018 (DE) ..... 10 2018 120 007.2

(51) Int. Cl.
*B04B 7/08* (2006.01)
*B04B 5/04* (2006.01)

(52) U.S. Cl.
CPC ..... *B04B 7/08* (2013.01); *B04B 5/0414* (2013.01)

(58) Field of Classification Search
CPC ..... B04B 7/08; B04B 5/0414; B04B 5/04; B04B 7/00
USPC ..... 494/16, 60
See application file for complete search history.

(56) References Cited

U.S. PATENT DOCUMENTS

| | | | | |
|---|---|---|---|---|
| 3,825,178 A * | 7/1974 | Burg | F16K 11/0836 494/61 |
| 4,824,429 A * | 4/1989 | Keunen | B04B 7/085 494/81 |
| 5,538,493 A | 7/1996 | Gerken et al. | |
| 2016/0193614 A1* | 7/2016 | Piramoon | B04B 7/085 494/60 |

FOREIGN PATENT DOCUMENTS

| | | | |
|---|---|---|---|
| DE | 3806284 C1 | | 4/1989 |
| DE | 4014440 C1 | * | 7/1991 |
| DE | 4014440 C1 | | 7/1991 |
| DE | 10233536 A1 | | 12/2004 |
| DE | 102011107667 A1 | | 1/2013 |
| DE | 112016000277 | | 10/2017 |
| EP | 0602485 B1 | | 8/1998 |

* cited by examiner

*Primary Examiner* — Shuyi S. Liu
(74) *Attorney, Agent, or Firm* — Smartpat PLC

(57) ABSTRACT

A fixed-angle rotor for centrifuges includes stiffening ribs on the lower side of its rotor body. Its rotational energy is comparatively low during operation even at high speeds, whereby safety is noticeably increased without the need for a reinforced armored vessel in the centrifuge that is equipped therewith. At the same time, the drive power required to drive the fixed-angle rotor remains low. The fixed-angle rotor also withstands extreme loads over a long period of time. In addition, the fixed-angle rotor can be manufactured cost-effectively, because no additional components are required; rather, the stiffening ribs can also be manufactured during the manufacture of the rotor body. Finally, very thin rotor shells can also be used, which improves the temperature control of the samples, because the fixed-angle rotor has very good structural stability, especially in the main load directions.

24 Claims, 9 Drawing Sheets

FIXED ANGLE CENTRIFUGE ROTOR WITH STIFFENING RIB

TECHNICAL FIELD

The disclosure concerns a fixed-angle centrifuge rotor.

BACKGROUND

Centrifuge rotors are used in centrifuges, in particular laboratory centrifuges, to separate the components of samples centrifuged therein by exploiting mass inertia. In doing so, increasingly higher rotational speeds are used to achieve high segregation rates. Laboratory centrifuges are centrifuges whose centrifuge rotors operate at preferably at least 3,000, preferably at least 10,000, in particular at least 15,000 revolutions per minute and are usually placed on tables. In order to be able to place them on a worktable, they have a form factor of less than 1 m×1 m×1 m, i.e. their installation space is limited. Preferably, the device depth is limited to a maximum of 70 cm. However, laboratory centrifuges that are formed as standing centrifuges (that is, they have a height in the range from 1 m to 1.5 m in order to be able to place them on the floor of a room) are also known.

Such centrifuges are used in the fields of medicine, pharmacy, biology and chemistry.

The samples to be centrifuged are stored in sample containers, and such sample containers are rotated by means of the centrifuge rotor. The centrifuge rotors are typically set in rotation by means of a vertical drive shaft, which is driven by an electric motor. The coupling between the centrifuge rotor and the drive shaft is typically effected by the hub of the centrifuge rotor.

There are different centrifuge rotors that are used depending on the application. The sample containers may contain the samples directly. Alternatively, individual sample receptacles, which contain the samples, are inserted into the sample containers, such that a large number of samples can be centrifuged simultaneously in one sample container. In general, centrifuge rotors in the form of fixed-angle rotors and swing-out rotors and others are known. This disclosure is based on fixed-angle rotors, in which the holders in the rotor body for the samples are arranged at a fixed angle with respect to the rotor axis, which is typically inclined. To be more precise, the inclination run from the opening of the holder to the outside. Such fixed-angle rotors are known from DE 38 06 284 C1, for example.

The problem is that, due to the dead weight of the fixed-angle rotors, the desired higher speeds require ever higher motor power, wherein high-strength materials such as steel, titanium and aluminum must be used for safety reasons.

Although it is already known from DE 102 33 536 A1, for example, to use fiber composite materials, but the weight reduction enabled thereby is low and the rotor weight is still so high that it is not possible to increase the rotational speed significantly.

To solve this problem, it was proposed in DE 10 2011 107 667 A1 to manufacture the rotor body from a porous metal and to provide an external reinforcement. Although this allows the rotor mass to be further reduced, thus improving the rotational speed with the same motor power, the reinforcement increases the mass on the outer radius of the centrifuge rotor. This increases the kinetic energy, resulting in high crash energies in the event of a crash. This can be a safety risk that should be compensated for by reinforcing the crash protection surrounding the centrifuge container of the centrifuge.

It is therefore the object of this disclosure to propose a fixed-angle rotor in order to avoid such disadvantages. Preferably, its rotational energy should be as low as possible in order to increase safety, and the drive power required to drive the centrifuge rotor should remain as low as possible. In particular, the fixed-angle rotor should be able to withstand extreme loads over a long period of time and should be manufactured at low cost.

SUMMARY

This object is solved with the fixed-angle rotor as claimed. Advantageous additional embodiments are described in the dependent claims and in the following description and are shown in the figures.

The inventor recognized that this object can be solved in a surprisingly simple manner if at least one stiffening rib is arranged on the lower side of the rotor body, because this ensures the structural stability of the rotor body at high speeds, even if the rotor body itself has less material.

Within the framework of this disclosure, "stiffening ribs" are physical ribs or bars that serve to increase the structural stability of the rotor body. These ribs or bars have at least one long side and one narrow side and run with their long side continuously between two areas of the rotor body. They can also run with an additional side between the long side and the rotor body, but do not have to, since they can also be formed to be hollow.

The fixed-angle rotor for a centrifuge, in particular a laboratory centrifuge, has a rotor body that has a hub and a rotor axis. The hub is arranged around the rotor axis. In the rotor body at least two holders for samples to be centrifuged are arranged around the rotor axis. The rotor body has an upper side and an oppositely arranged lower side. The holders have openings on the upper side for introducing the samples. The rotor body has at least one stiffening rib on its lower side.

In an exemplary embodiment, at least one of the at least one stiffening ribs runs in a radial manner in relation to the rotor axis, advantageously runs in direction of the holder, and in particular runs in direction of a central axis of the holder. This allows centrifugal forces to be supported particularly well. In this context, "central axis" is a virtual center line along which a sample to be centrifuged will be inserted.

In another exemplary embodiment, at least one of the at least one stiffening ribs runs between one holder and the hub, advantageously is connected with the holder and the hub. In this case, there is a special structural stability of the centrifuge rotor in relation to centrifugal forces, especially if there is more rotor body material in the area of the holders in relation to the circumference of the rotor body than next to it.

In one advantageous additional form, it is provided that at least one of the at least one stiffening ribs runs in a tangential manner with respect to the rotor axis and at a distance to the rotor axis. This allows forces to be particularly well-supported during acceleration and deceleration.

In another exemplary embodiment, at least one of the at least one stiffening ribs runs between the two holders, advantageously is connected with the two holders, and in particular runs in direction of the respective central axis of the respective holder. In this case, there is a special structural stability of the centrifuge rotor in relation to the forces acting during acceleration and deceleration, especially if there is more rotor body material in the area of the holders in relation to the circumference of the rotor body than next to it.

In another exemplary embodiment, the fixed-angle rotor has a rotationally symmetrical rotor shell that encloses the holders. This means that the centrifuge rotor is aerodynamically enclosed and offers little flow resistance to a surrounding fluid.

In another exemplary embodiment, the holders transition into the rotor shell at least in areas. In this case, the rotor body is very stable in terms of structure, even if there is little material surrounding the holders.

In another exemplary embodiment, the rotor body has on its lower side, in addition to the at least one stiffening rib, at least one cavity for reducing material extending in an axial manner with respect to the rotor axis. As a result, the fixed-angle rotor has less mass and nevertheless has a sufficiently high structural stability, such that less drive power is required. In addition, the kinetic energy stored in the fixed-angle rotor during operation is lower. The cavity is preferably arranged between the holders, in particular a) between the rotor shell, the walls of two adjacent holders and a tangentially running stiffening rib or b) between a tangentially running stiffening rib, two adjacent radially running stiffening ribs and the hub or c) between the rotor shell, the walls of two adjacent holders, two adjacent radially running stiffening ribs and the hub.

In another exemplary embodiment, the cavity extends at least in areas up to the rotor shell and/or up to the hub and/or up to a holder and/or up to the cover surface of the upper side of the rotor body bounding the rotor chamber, in particular without breaking through such elements.

In another exemplary embodiment, the thickness of the rotor shell and/or the thickness of the stiffening rib and/or the thickness of the wall of the holder and/or the thickness of the rotor body on its upper side is, at least in areas, less than 1 cm, preferably less than 5 mm, in particular less than 3 mm, preferably 1.5 mm. As a result, the fixed-angle rotor is still particularly stable in terms of structure, but has a very low mass.

In another exemplary embodiment, it is provided that, in the wall of the rotor shell, in the wall of the at least two holders, on the at least one stiffening rib and/or on the cavity, there is a gradation with respect to the material thickness of the rotor body at least in areas; this is preferably arranged in an axial manner with respect to the rotor axis, wherein the gradation is in particular stair-shaped. This gradation is provided in particular in at least areas that are inclined with respect to the rotor axis. This results in a particularly stable stiffening of the rotor body, such that it can withstand even the highest loads.

In another exemplary embodiment, the gradation has a step width and/or step height in the range of 0.5 mm to 8 mm, preferably in the range of 1 mm to 6 mm, in particular in the range of 2 mm to 5 mm. The smaller such step dimension, the lighter the fixed-angle rotor, but the stiffening effect is also smaller. The smaller such step dimension, the higher the manufacturing effort as well. In contrast, the larger the step dimension, the higher the weight of the fixed-angle rotor. For the specified ranges, there is sufficient weight reduction with sufficiently high stability and nevertheless low manufacturing effort.

In another exemplary embodiment, the lower side of the rotor body has a cover that covers the stiffening ribs and/or the cavities, whereby the fixed-angle rotor is very favorably formed in terms of aerodynamics, despite the stiffening ribs and/or the cavities. This avoids wind noise and significantly reduces wind resistance, which reduces power consumption. In addition, a closed fixed-angle rotor is generated by the cover, which promotes haptics and cleanability. The cover is preferably clamped and/or screwed to the rotor body.

In one advantageous additional form, it is provided that the cavities are configured closed except for an opening for inserting the samples to be centrifuged. As a result, the fixed-angle rotor has a good cleanability and stability.

The following detailed description is merely exemplary in nature and is not intended to limit the invention or the application and uses of the invention. Furthermore, there is no intention to be bound by any theory presented in the preceding background or the following detailed description.

DETAILED DESCRIPTION

Figure 1:
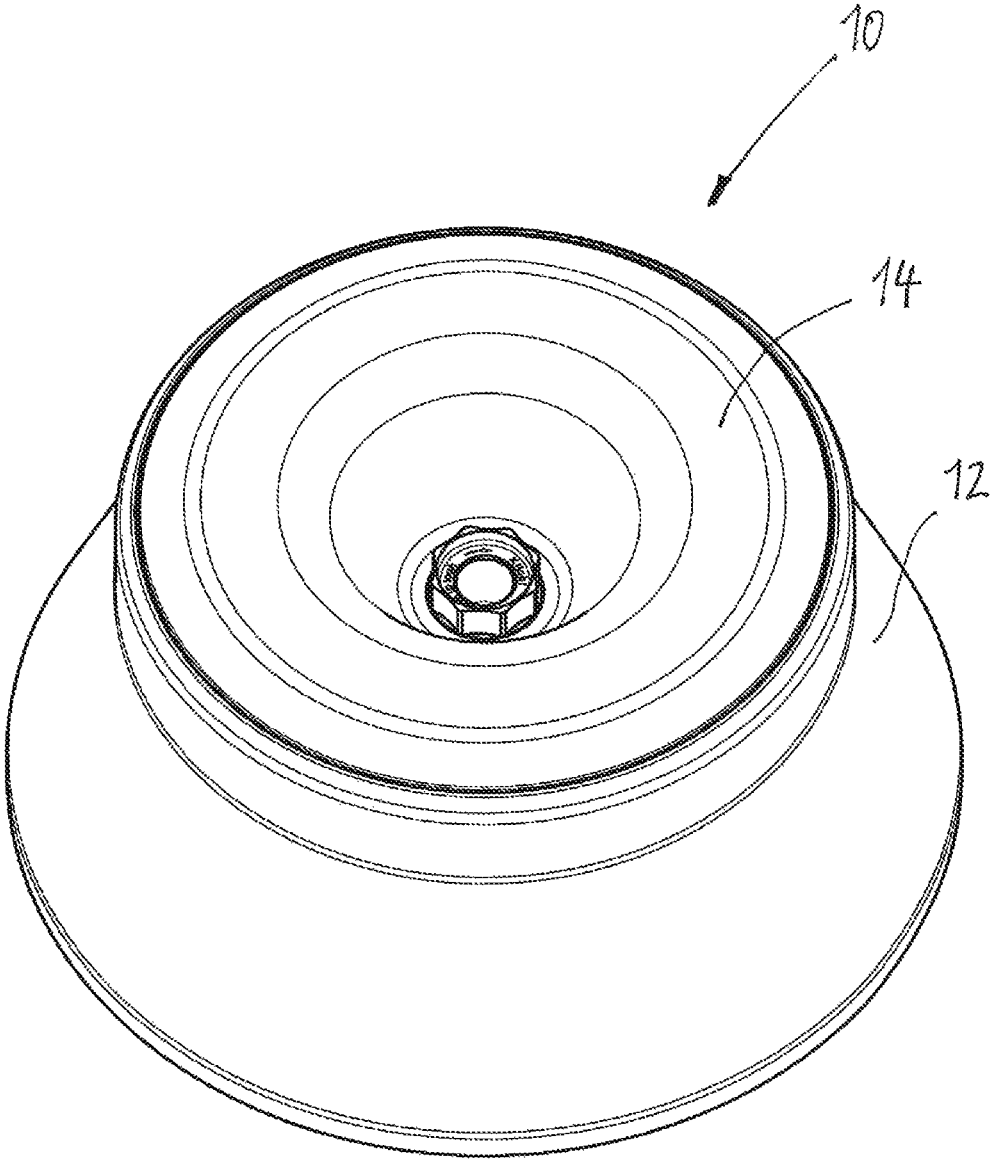
FIG. 1 shows a first embodiment of a fixed-angle rotor in a perspective view from above.

FIGS. 1 to 4 show a first exemplary embodiment of a fixed-angle rotor 10.

The fixed-angle rotor 10 has a rotor body 12 and a cover 14 that enclose a rotor chamber 16 between them. The rotor body 12 has a hub 18 that extends along the rotor axis R and serves to couple with a drive shaft of a centrifuge motor of a laboratory centrifuge in the usual manner, and therefore does not need to be shown in greater detail.

In the rotor body 12, holders 22 are arranged on its upper side 20, in which sample containers with samples to be centrifuged can be inserted and centrifuged in the usual manner. The sample containers correspond with the rotor chamber 16. A seal 23 is provided between the rotor body 12 and the cover 14, by which a damping between the cover 14 and the rotor body 12 takes place, which prevents possible rattling. If the seal 23 is suitably formed, the rotor chamber 16 can also be sealed in an aerosol-tight manner against the surrounding area 24 of the fixed-angle rotor 10.

With respect to the outer circumference 26 of the rotor body 12, the rotor body 12 is bounded by a rotor shell 28, which is formed to be rotationally symmetrical and thus aerodynamically encloses the centrifuge rotor, by which the fixed-angle rotor 10 in the laboratory centrifuge offers little flow resistance to the surrounding fluid.

As shown, the walls 29 of the holders 22 merge into the rotor shell 28 at least in areas. The rotor shell 28 thus forms the walls 29 directly in the areas 30 where the rotor shell 28 meets the holders 22 tangentially. The walls 29 of the holder 22 is configured closed except for an opening for inserting the samples to be centrifuged.

Furthermore, the rotor body 12 has numerous stiffening ribs 36, 38 on its lower side 32, which extends between the hub 18 and the lower edge 34 of the rotor shell 28. A first type of stiffening rib 36 runs in a radial manner with respect to the rotor axis R between the holders 22 and the hub 18. This stiffening rib 36 connects the hub 18 and the holder 22, and runs in direction of the central axis Z of the holder 22. A second type of stiffening rib 38 runs tangentially with respect to the rotor axis R between adjacent holders 22, i.e. with distance to the rotor axis R, wherein the second type of stiffening rib 38 is connected with each of the two holders 22 and runs in direction of the respective central axis Z of the respective holder 22. Both stiffening ribs 36, 38 extend from the lower side 32 of the rotor body 12 to the cover surface 40 of the upper side 20 of the rotor body 12, which bounds the rotor chamber 16.

In addition, the rotor body 12 has numerous cavities 42, 44 on its lower side 32 for reducing material. A first type of cavity 42 is arranged between the rotor shell 28, the walls 29 of two adjacent holders 22 and the second type of stiffening ribs 38. A second type of cavity 44 is arranged between the second type of stiffening ribs 38, two adjacent stiffening ribs 36 of the first type and the hub 18. Both types of cavities each extend from the lower side 32 of the rotor body 12 to the cover surface 40 of the upper side 20 of the rotor body 12, which bounds the rotor chamber 16.

The wall thicknesses are formed such that they amount to approximately 1.7 mm for the rotor shell 28, 6 mm for the stiffening ribs 36 of the first type and 5 mm for the stiffening ribs 38 of the second type. The wall thickness of the cover surface 40 in the areas of the cavities 42, 44 amounts to less than 5 mm, preferably 1.5 mm.

By combining the cavities 42, 44 for reducing material with the stiffening ribs 36, 38 and the rotor shell 28, the fixed-angle rotor 10 has a very low mass, yet is particularly stable in terms of structure, such that less drive power is required. In addition, the kinetic energy stored in the fixed-angle rotor 10 during operation is relatively low.

Such high structural stability is further enhanced by the fact that the inner wall 46 of the rotor shell 28, the walls 29 of the holders 22 and the transitions 48, 50 between the walls 29 of the holders 22 and the stiffening ribs 36, 38 as well was the cavities 42, 44 are provided with a gradation 54 that is arranged in an axial manner with respect to the rotor axis R. Thereby, the gradation 54 is formed to be stair-shaped, wherein the step width and step height each amount to 5 mm. On the other hand, the lower sides 56 of the holders 22 are not provided with such a gradation 54. This gradation 54 results in a particularly stable stiffening of the rotor body 12, such that it can withstand the highest loads despite the saving of weight. The gradation 54 also could be formed continuous instead of stair-shaped (discontinuous).

Figure 2:
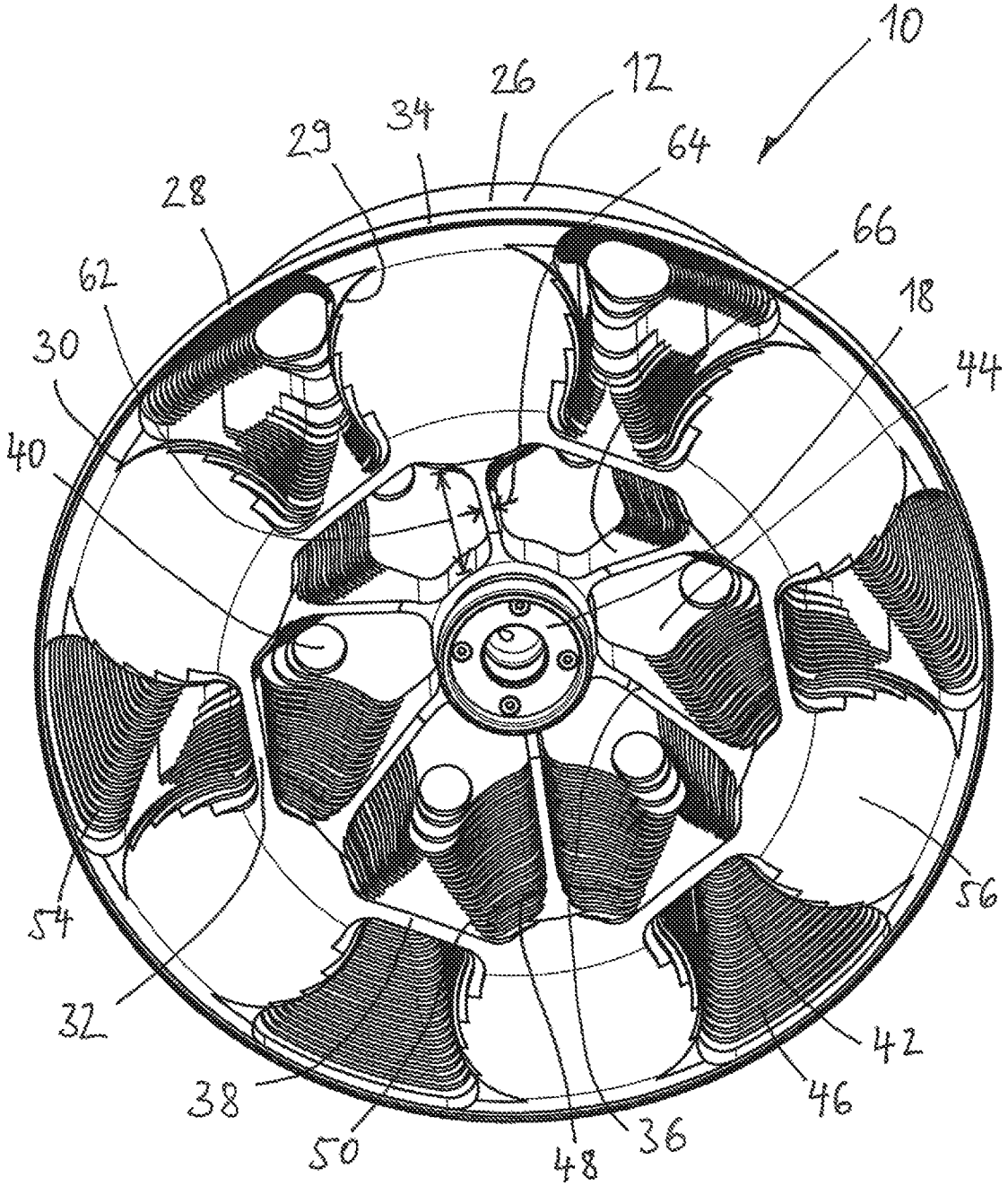
FIG. 2 shows the fixed-angle rotor according to FIG. 1 in a perspective view from below.
Figure 3:
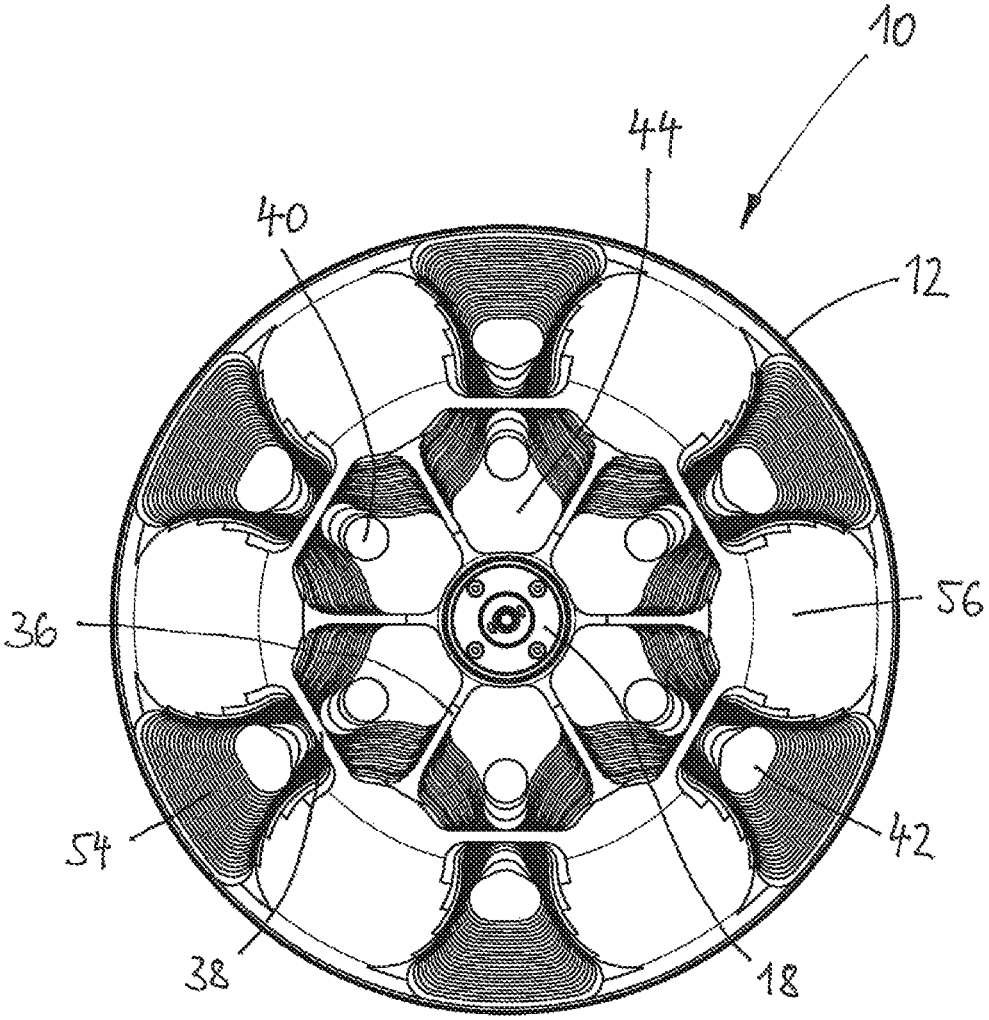
FIG. 3 shows the fixed-angle rotor according to FIG. 1 in a plan view from below.
Figure 4:
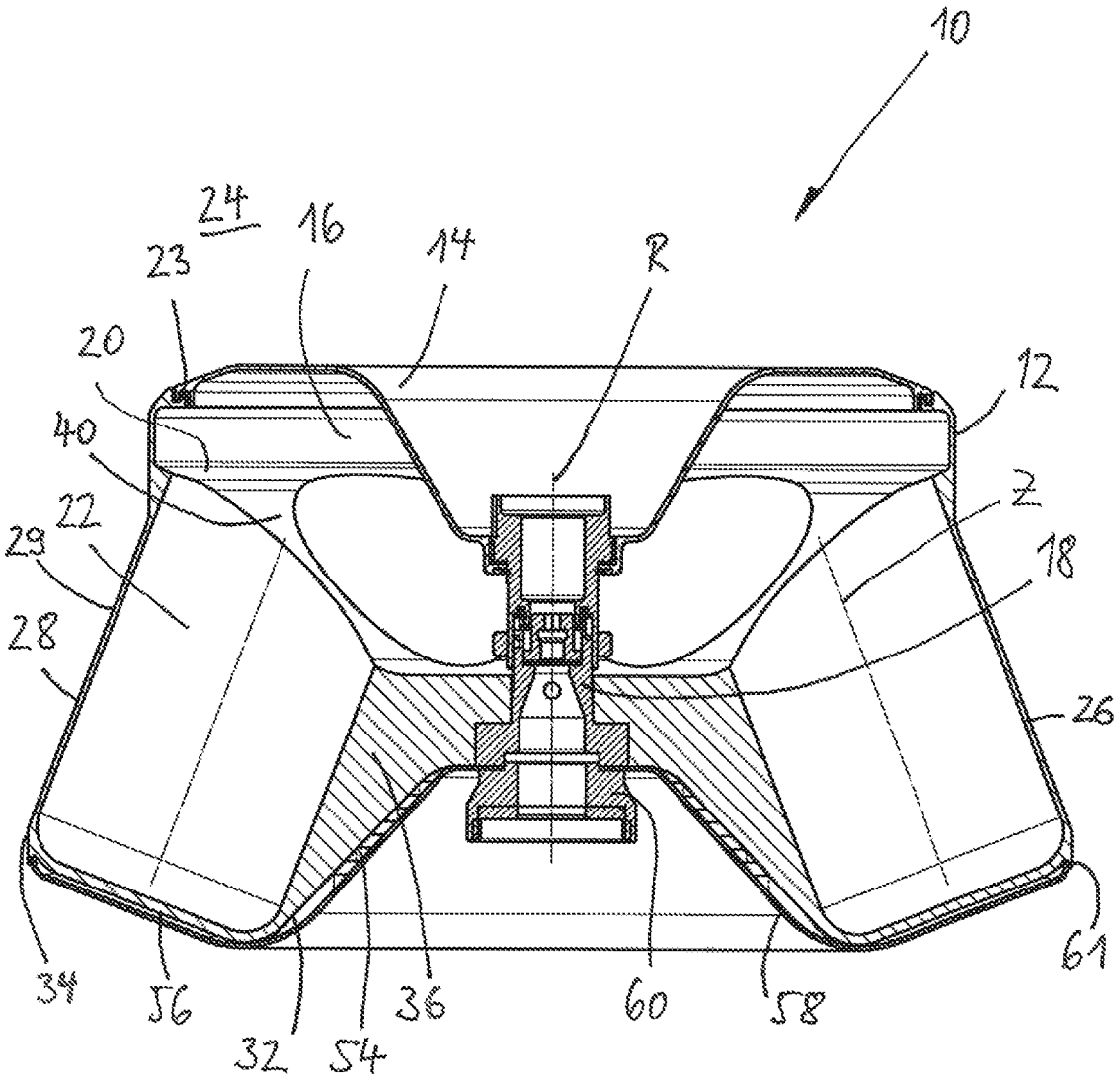
FIG. 4 shows the fixed-angle rotor according to FIG. 1 in a sectional view.
Figure 5:
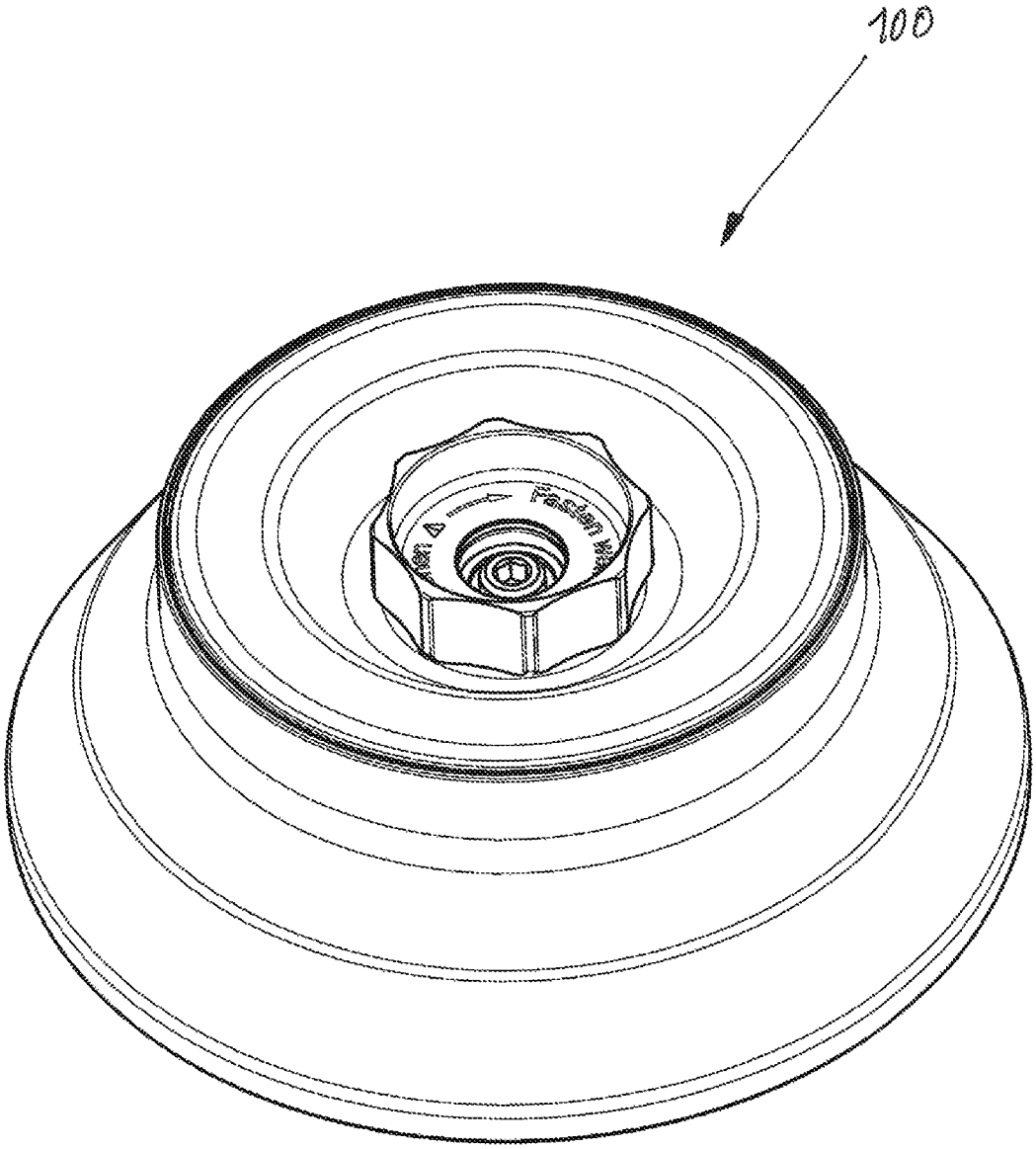
FIG. 5 shows a second embodiment of a fixed-angle rotor in a perspective view from above.

In addition, the fixed-angle rotor 10 has a lower cover 58 that is fixed (clamped) to the lower side 32 of the rotor body 12 by means of the coupling 60 of the hub 18, and is supported laterally on projections 61 of the rotor shell 28 (for better understanding, this cover 58 is not shown in FIGS. 2 and 3). Given such cover 58, the fixed-angle rotor 10 provided with the stiffening ribs 36, 38 and the cavities 42, 44 is nevertheless very favorably formed in terms of aerodynamics and has a significantly lower overall weight compared to earlier fixed-angle rotors.

FIGS. 5 to 8 show a second exemplary design of the fixed-angle rotor 100. There are similarities with the fixed-angle rotor 10 of the first preferred design, such that only the differences are addressed in the following.

In case of the fixed-angle rotor 100, the rotor body 102 has not only six, but ten smaller holders 104 for samples.

Furthermore, the rotor body 102 has numerous stiffening ribs 114 on its lower side 106, which extends between the hub 108 and the lower edge 110 of the rotor shell 112. However, there is only one type of stiffening rib 114, which, with respect to the rotor axis R', extends in a radial manner between the holders 104 and the central hub 108 and extend in an axial manner from the lower side 106 to the cover surface 118 of the upper side 120 of the rotor body 102 bounding the rotor chamber 116. This stiffening ribs 114 also run between hub 108 and holders 104, wherein the stiffening rips 114 are each connected with hub 108 and the holder 104, and run in direction of the central axis Z of the respective holder 104.

Accordingly, there is also only one type of cavity 122 for reducing material in the rotor body 102. Such cavities 122 are arranged between the rotor shell 112, the walls 124 of two adjacent holders 104, the adjacent stiffening ribs 114 and the hub 108, extending from the lower side 106 of the rotor body 102 to the cover surface 118 of the upper side 120 of the rotor body 102 bounding the rotor chamber 116.

The wall thicknesses are formed such that they amount to approximately 1.7 mm for the rotor shell 112, 7 mm for the stiffening ribs 114 and less than 5 mm, preferably 1.5 mm, for the cover surface 118 in the areas of the cavities 122.

This fixed-angle rotor 100 also has a very low mass due to the combination of the cavities 122 for reducing material with the stiffening ribs 114 and the rotor shell 112, but is nevertheless particularly stable in terms of structure, such that less drive power is required. In addition, the kinetic energy stored in the fixed-angle rotor 100 during operation is relatively low.

This high structural stability is further enhanced by the fact that the wall 126 of the rotor shell 112, the walls 124 of the holders 104, the transitions 128 between the walls 124 of the holders 104 and the rotor shell 112 and the transitions 130 between the stiffening ribs 114 and the hub 108 as well was the cavities 122 are provided with a gradation 132, which is arranged in an axial manner with respect to the rotor axis R'. Thereby, the gradation 132 is likewise formed to be stair-shaped, wherein the step width and the step height each amount to 2 mm. The lower sides 134 of the holders 104 are in turn not provided with such a gradation 132. This gradation 132 results in a particularly stable stiffening of the rotor body 102, such that it can withstand the highest loads despite the saving of weight.

Figure 6:
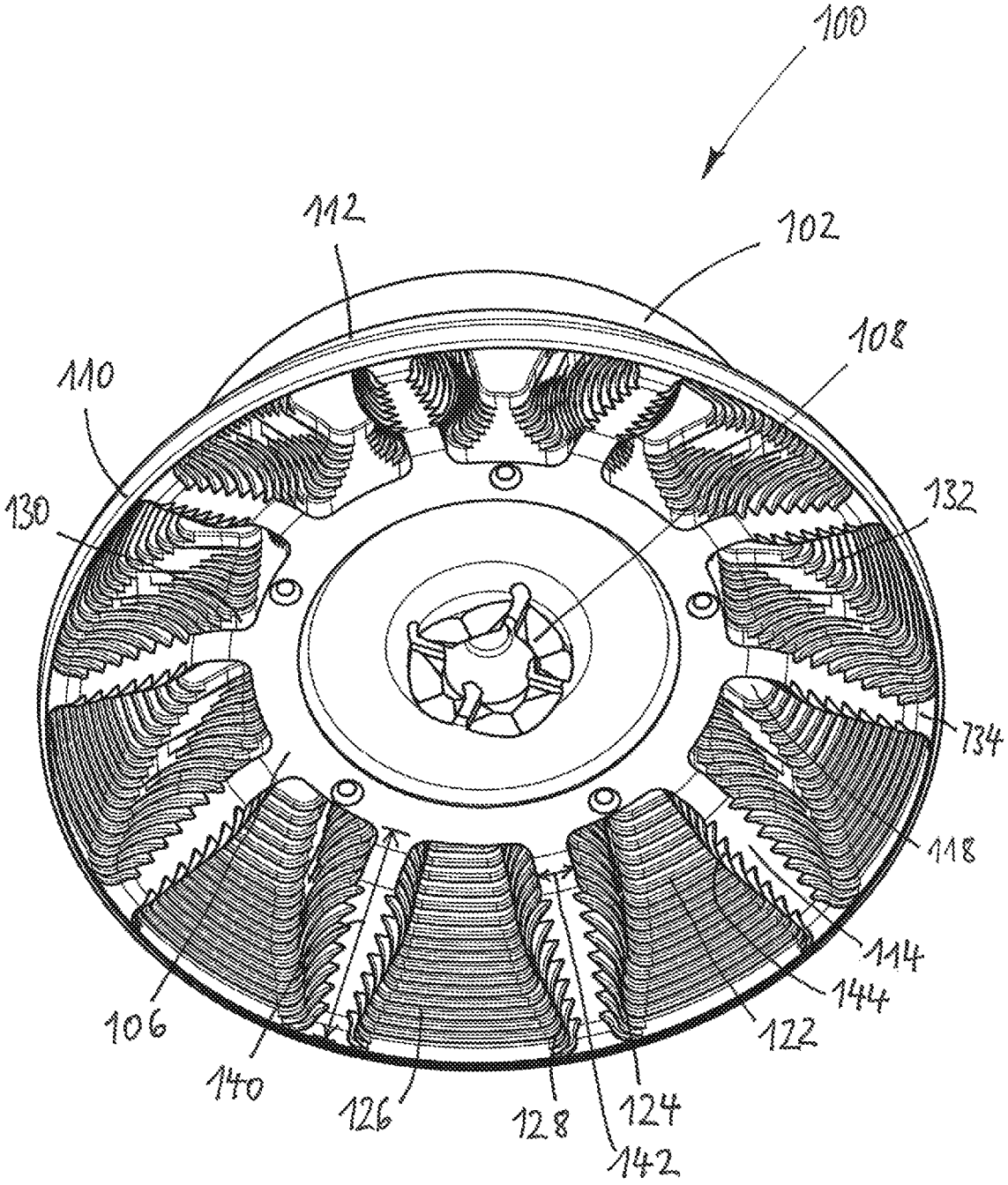
FIG. 6 shows the fixed-angle rotor according to FIG. 5 in a perspective view from below.
Figure 7:
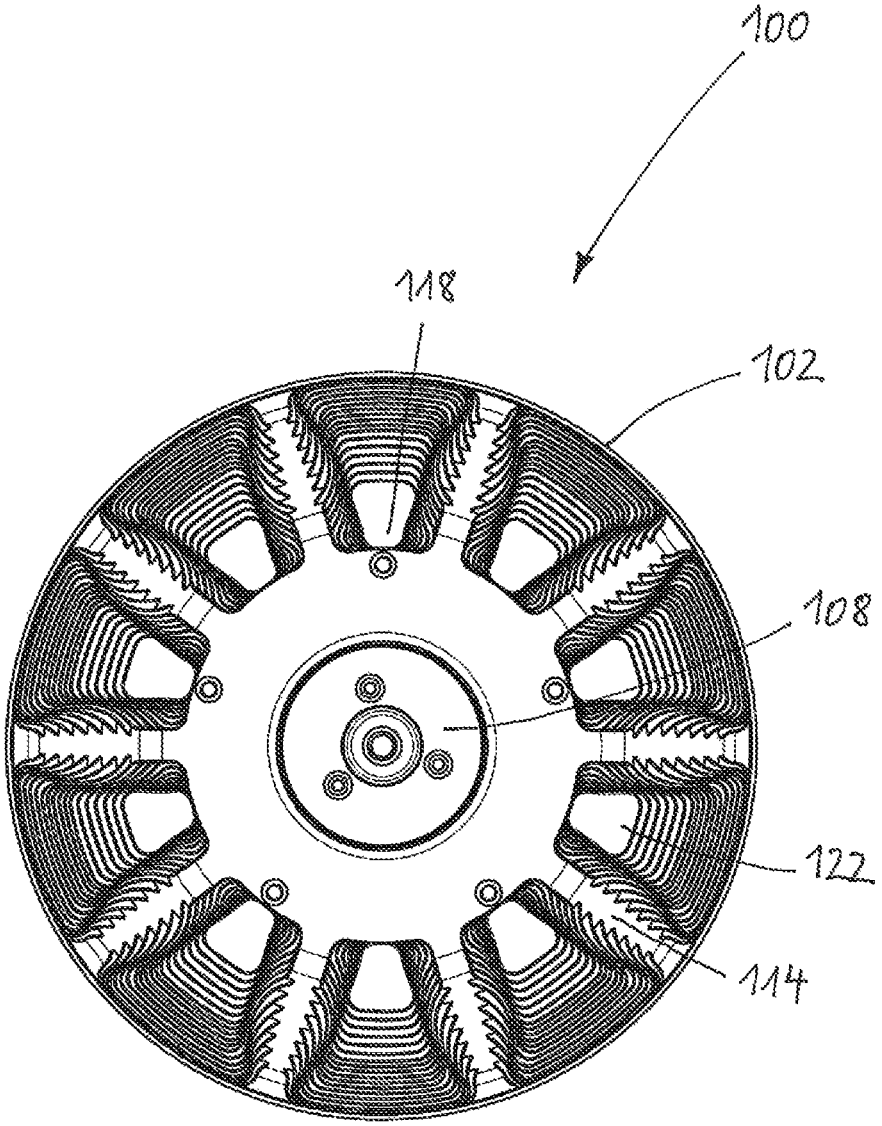
FIG. 7 shows the fixed-angle rotor according to FIG. 5 in a plan view from below.
Figure 8:
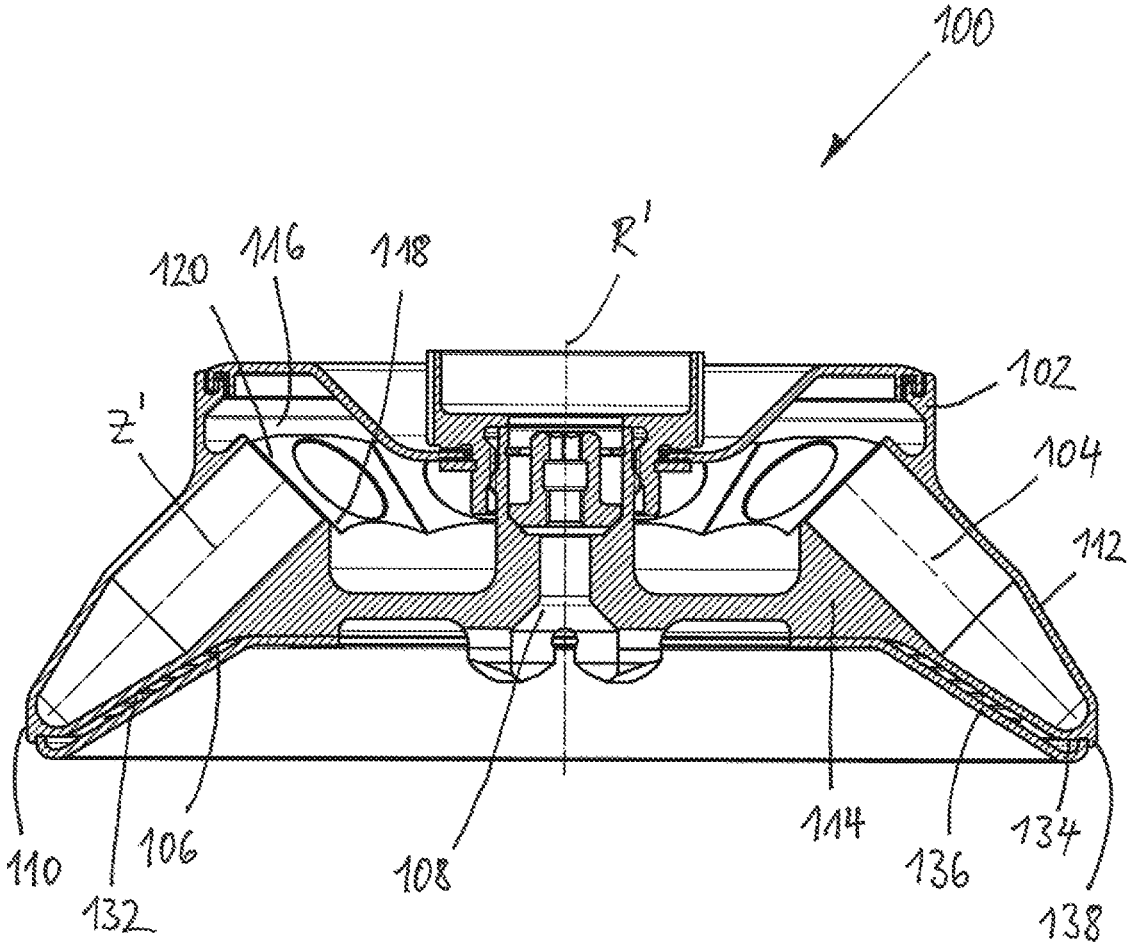
FIG. 8 shows the fixed-angle rotor according to FIG. 5 in a sectional view.

In addition, the fixed-angle rotor 100 has a lower cover 136 that is fixed to the lower side 106 of the rotor body 102 by a screw connection (not shown) and is supported laterally on projections 138 of the rotor shell 112 (for better understanding, this cover 136 is not shown in FIGS. 6 and 7). Given such cover 136, the fixed-angle rotor 100 provided with the stiffening ribs 114 and the cavities 122 is nevertheless very favorably formed in terms of aerodynamics and has a significantly lower overall weight compared to earlier fixed-angle rotors.

With both fixed-angle rotors 10, 100, the rotor bodies 12, 102 can be manufactured in one piece, for example by milling and turning the rotor body 12, 102 out of a blank (for example, from a round material or a drop-forged piece made of aluminum or steel) by means of CNC machining. Alternatively, there could also be a multi-piece manufacturing in which the hub 18, 108 is manufactured independently and inserted into (for example, screwed in) the rotor body 12, 102.

Each of the stiffening ribs 36, 38, 114 has a long side 62, 140 and a narrow side 64, 142. They also have one additional side 66, 144 which runs continuously between the long side 62, 140 and the rotor body 12, 102. Alternatively, it could also be provided that the additional side 66, 144 is not continuously formed between the long side 62, 140, whereby the stiffening ribs 36, 38, 114 would be hollow and adjacent cavities would communicate with each other, but this would also result in improved structural stability with a significantly reduced mass.

Figure 9:
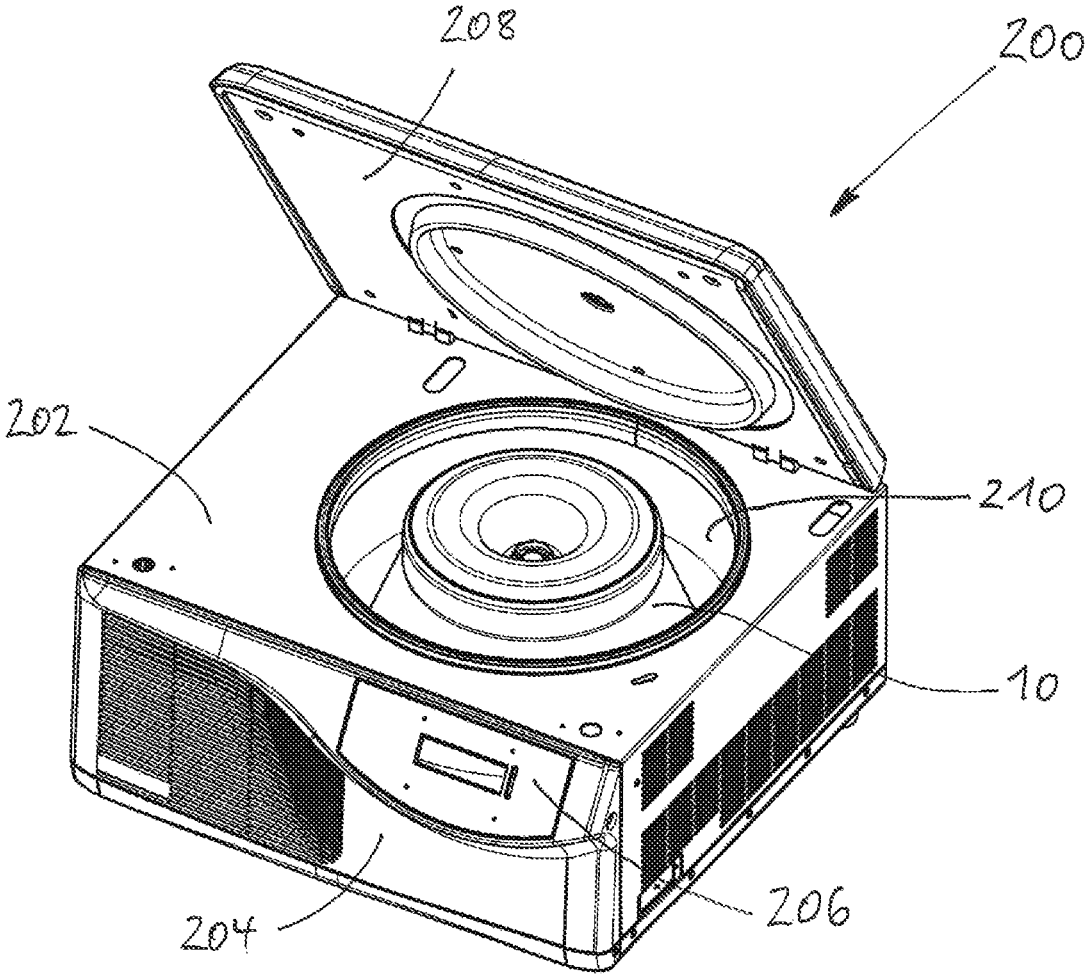
FIG. 9 shows a centrifuge equipped with the fixed-angle rotor in in a perspective view.

FIG. 9 shows a laboratory centrifuge 200 equipped with the fixed-angle rotor 10.

The laboratory centrifuge 200 is formed in the usual manner, comprising a housing 202 with a control panel 206 arranged at its front side 204 and a cover 208 provided to close the centrifuge container 210. The fixed-angle rotor 10, which can be driven by the shaft of a centrifuge motor (both not shown), is arranged in the centrifuge container 210.

It has become clear from the preceding illustration that the disclosure provides a fixed-angle rotor 10, 100 for centrifuges 200, whose rotational energy is comparatively low during operation even at high speeds. Thereby safety is noticeably increased without the need for a reinforced armored vessel in the centrifuge that is equipped with the fixed-angle rotor 10, 100. At the same time, the drive power required to drive the fixed-angle rotor 10, 100 remains low. The fixed-angle rotor 10, 100 also withstands extreme loads over a long period of time. In addition, the fixed-angle rotor 10, 100 can be manufactured cost-effectively, because no additional components are required. Rather, the stiffening ribs 36, 38, 114 can be manufactured during the manufacture of the rotor body 12, 102. Finally, very thin rotor shells 28, 112 can be used, which improves the temperature control of the samples, because the fixed-angle rotor has very good structural stability, especially in the main load directions.

While the present invention has been described with reference to exemplary embodiments, it will be readily apparent to those skilled in the art that the invention is not limited to the disclosed or illustrated embodiments but, on the contrary, is intended to cover numerous other modifications, substitutions, variations and broad equivalent arrangements that are included within the spirit and scope of the following claims.

LIST OF REFERENCE SIGNS

10 Fixed-angle rotor in a first preferred design
12 Rotor body
14 Cover
16 Rotor chamber
18 Hub
20 Upper side of the rotor body
22 Holder
23 Seal between cover 14 and rotor body 12
24 Surrounding area of the fixed-angle rotor 10
26 Outer circumference of the rotor body 12
28 Rotor shell
29 Walls of the holders 22
30 Areas of the rotor shell 28 where the rotor shell 28 meets the holders 22 tangentially
32 Lower side of the rotor body 12
34 Lower edge of the rotor shell 28
36 Stiffening ribs of the first type
38 Stiffening ribs of the second type
40 Cover surface of the upper side 20 bounding the rotor chamber 16
42 Cavities of the first type in the rotor body 12
44 Cavities of the second type in the rotor body 12
46 Wall of the rotor shell 28
48 Transitions between the walls 29 of the holders 22 and the stiffening ribs 36
50 Transitions between the walls 29 of the holders 22 and the stiffening ribs 38
54 Gradation
56 Lower side of the holder 22
58 Lower cover
60 Coupling
61 Projections of the rotor shell 28
62 Long side of the stiffening ribs 36, 38
64 Narrow side of the stiffening ribs 36, 38
66 Additional side of the stiffening ribs 36, 38
100 Fixed-angle rotor 100 in a second preferred design
102 Rotor body
104 Holder
106 Lower side of the rotor body
108 Hub
110 Lower edge of the rotor shell 112
112 Rotor shell
114 Stiffening ribs
116 Rotor chamber
118 Cover surface of the upper side 120
120 Upper side
122 Cavities in the rotor body 102
124 Walls of the holders 104
126 Wall of the rotor shell 112
128 Transitions between the walls 124 of the holders 104 and the stiffening ribs 114
130 Transitions between the stiffening ribs 114 and the hub 108
132 Gradation
134 Lower sides of the holder 102
136 Lower cover
138 Projections of the rotor shell 112
140 Long side of the stiffening ribs 114
142 Narrow side of the stiffening ribs 114
144 Additional side of the stiffening ribs 114
200 Laboratory centrifuge
202 Housing
204 Front side of the housing 202
206 Control panel
208 Cover
210 Centrifuge container
R Rotor axis
R' Rotor axis
Z central axis of holder 22
Z' central axis of holder 104

What is claimed is:

1. A fixed-angle rotor for a centrifuge, comprising:

a rotor body having an upper side and an oppositely arranged lower side and a hub which is arranged around a rotor axis;

at least two holders for samples to be centrifuged arranged in the rotor body around the rotor axis, wherein the at least two holders have openings on the upper side for introducing samples; and stiffening ribs formed on the lower side of the rotor body, wherein at least one of the stiffening ribs extends radially from the hub to at least one of the at least two holders and runs in a direction of a central axis of the at least one of the at least two holders.

2. The fixed-angle rotor according to claim 1,
wherein the at least one of the stiffening ribs connects a wall of the at least one of the at least two holders to the hub.

3. The fixed-angle rotor according to claim 1,
wherein at least one of the stiffening ribs runs in a tangential manner with respect to the rotor axis and at a distance to the rotor axis.

4. The fixed-angle rotor according to claim 1,
wherein at least one of the stiffening ribs runs between the at least two holders.

5. The fixed-angle rotor according to claim 1,
wherein at least one of the stiffening ribs runs between the at least two holders and is connected with the at least two holders.

6. The fixed-angle rotor according to claim 1,
wherein at least one of the stiffening ribs runs between the at least two holders in direction of the respective central axis of the respective holder.

7. The fixed-angle rotor according to claim 1,
wherein the fixed-angle rotor has a rotationally symmetrical rotor shell that encloses the at least two holders.

8. The fixed-angle rotor according to claim 7,
wherein the at least two holders transition into the rotor shell at least in areas.

9. The fixed-angle rotor according to claim 7,
wherein the rotor body has, in addition to the stiffening ribs, on its lower side at least one cavity extending in an axial manner with respect to the rotor axis for reducing material.

10. The fixed-angle rotor according to claim 9,
wherein the cavity is arranged between the at least two holders.

11. The fixed-angle rotor according to claim 9,
wherein the cavity is arranged
a) between the rotor shell, walls of two adjacent ones of the at least two holders, and a tangentially running stiffening rib, and/or
b) between a tangentially running stiffening rib, two adjacent radially running stiffening ribs and the hub and/or
c) between the rotor shell, walls of two adjacent ones of the at least two holders, two adjacent radially running stiffening ribs, and the hub.

12. The fixed-angle rotor according to claim 9,
wherein the cavity extends at least in areas
up to the rotor shell and/or
up to the hub and/or
up to the at least one of the at least two holders and/or
up to a cover surface of the upper side of the rotor body bounding a rotor chamber.

13. The fixed-angle rotor according to claim 12,
wherein the cavity does not break through the rotor shell, the hub, the at least one of the at least two holders, and the cover surface.

14. The fixed-angle rotor according to claim 7, wherein
a thickness of the rotor shell and/or
a thickness of the stiffening rib and/or
a thickness of a wall of the at least two holders and/or
a thickness of the rotor body on its upper side
is, at least in areas, less than 1 cm.

15. The fixed-angle rotor according to claim 7, wherein
a thickness of the rotor shell and/or
a thickness of the stiffening rib and/or
a thickness of a wall of the at least two holders and/or
a thickness of the rotor body on its upper side
is, at least in areas, less than 5 mm.

16. The fixed-angle rotor according to claim 7, wherein
a thickness of the rotor shell and/or
a thickness of the stiffening rib and/or
a thickness of a wall of the at least two holders and/or
a thickness of the rotor body on its upper side
is, at least in areas, less than 3 mm.

17. The fixed-angle rotor according to claim 7, wherein
a gradation with respect to the material thickness of the rotor body is provided, at least in areas,
in a wall of the rotor shell,
in a wall of the at least two holders,
on the stiffening rib, and/or
on a cavity between the at least two holders.

18. The fixed-angle rotor according to claim 17,
wherein the gradation is arranged in an axial manner with respect to the rotor axis.

19. The fixed-angle rotor according to claim 17,
wherein the gradation is stair-shaped.

20. The fixed-angle rotor according to claim 17,
wherein the gradation has a step width and/or step height in the range of 0.5 mm to 8 mm.

21. The fixed-angle rotor according to claim 17,
wherein the gradation has a step width and/or step height in the range of 1 mm to 6 mm.

22. The fixed-angle rotor according to claim 17,
wherein the gradation has a step width and/or step height in the range of 2 mm to 5 mm.

23. The fixed-angle rotor according to claim 1,
wherein the lower side of the rotor body has a cover that covers the stiffening ribs.

24. The fixed-angle rotor according to claim 1, wherein the at least two holders are configured closed except for an opening for inserting the samples to be centrifuged.

* * * * *